US009915430B2

(12) United States Patent
Pianezze et al.

(10) Patent No.: US 9,915,430 B2
(45) Date of Patent: Mar. 13, 2018

(54) GAS LIGHTING DEVICE HAVING SIMPLIFIED FASTENING MEANS TO AN ELECTRIC HOUSEHOLD APPLIANCE, IN PARTICULAR A COOKING RANGE

(75) Inventors: Daniele Pianezze, Cassano Magnago (IT); Massimo Aleardi, Cassano Magnago (IT)

(73) Assignee: ITW INDUSTRIAL COMPONENTS S.R.I. CON UNICO SOCIO, Milan (IT)

( * ) Notice: Subject to any disclaimer, the term of this patent is extended or adjusted under 35 U.S.C. 154(b) by 613 days.

(21) Appl. No.: 12/529,336

(22) PCT Filed: Mar. 24, 2008

(86) PCT No.: PCT/IB2008/000680

§ 371 (c)(1),
(2), (4) Date: Aug. 31, 2009

(87) PCT Pub. No.: WO2008/117155

PCT Pub. Date: Oct. 2, 2008

(65) Prior Publication Data

US 2010/0031951 A1 Feb. 11, 2010

(30) Foreign Application Priority Data

Mar. 26, 2007 (IT) ..... TO2007A0218

(51) Int. Cl.

| | |
|---|---|
| ***G12B 9/00*** | (2006.01) |
| ***F24C 3/10*** | (2006.01) |
| ***F23Q 3/00*** | (2006.01) |

(52) U.S. Cl.
CPC ..... *F24C 3/103* (2013.01); *F23Q 3/00* (2013.01)

(58) Field of Classification Search
CPC ..... F24C 3/103; F24C 3/00; B60K 2350/941; F16L 55/035; F16B 2/22; F16B 2/20;
(Continued)

(56) References Cited

U.S. PATENT DOCUMENTS 3,213,189 A * 10/1965 Mitchell ..... F16B 9/023 174/138 R
4,211,905 A * 7/1980 Quigley ..... H02B 1/048 200/16 C (Continued)

FOREIGN PATENT DOCUMENTS

CN 2830750 Y 10/2006
DE 4410512 A1 10/1995

(Continued)

*Primary Examiner* — Christopher Garft
(74) *Attorney, Agent, or Firm* — Hauptman Ham, LLP

(57) ABSTRACT

A gas lighting device having a casing fastenable to an electric household appliance by means of fastening means coupleable with corresponding perforations obtained on a carrying element of the electric household appliance; wherein the fastening means consist of at least one pair of elastically deformable fastening elements protrudingly carried by the casing, perpendicularly to the same, in a position immediately adjacent one to the other so that they are adapted to snappingly couple with only one and the same of said perforations of the carrying element of the electric household appliance.

16 Claims, 1 Drawing Sheet

(58) Field of Classification Search
CPC ..... F16B 2/245; F16B 2/243; F21V 21/088; B60L 2350/941
USPC ..... 248/27.3, 71, 216.1
See application file for complete search history.

(56) References Cited

U.S. PATENT DOCUMENTS

| | | | | |
|---|---|---|---|---|
| 4,340,795 | A * | 7/1982 | Arthur | H02B 1/048 200/295 |
| 5,217,190 | A * | 6/1993 | Reed | H01R 13/745 200/296 |
| 5,230,257 | A * | 7/1993 | Nowak | F16C 1/14 248/71 |
| 6,429,606 | B1 * | 8/2002 | Aleardi | F23Q 3/00 315/363 |
| 6,506,047 | B1 * | 1/2003 | Aleardi | F23Q 3/00 126/39 BA |
| 6,796,792 | B1 | 9/2004 | Aleardi et al. | |
| 6,854,693 | B2 * | 2/2005 | Harrison | H02G 3/32 24/16 PB |
| 7,036,779 | B2 * | 5/2006 | Kawaguchi | F16B 5/0642 174/135 |
| 7,097,447 | B2 * | 8/2006 | Pianezze | F23Q 3/00 336/180 |
| 2010/0031951 | A1 * | 2/2010 | Pianezze | F23Q 3/00 126/39 E |

FOREIGN PATENT DOCUMENTS

| | | | |
|---|---|---|---|
| EP | 0470471 | A | 2/1992 |
| EP | 1101067 | A | 5/2001 |
| WO | 0007217 | A | 2/2000 |

* cited by examiner

GAS LIGHTING DEVICE HAVING SIMPLIFIED FASTENING MEANS TO AN ELECTRIC HOUSEHOLD APPLIANCE, IN PARTICULAR A COOKING RANGE

RELATED APPLICATIONS

The present application is based on International Application Number PCT/IB2008/000680 filed Mar. 24, 2008, and claims priority from Italian Application Number TO2007A000218 filed Mar. 26, 2007, the disclosures of which are hereby incorporated by reference herein in their entirety.

TECHNICAL FIELD

The present invention relates to a gas lighting device of the type intended to equip an electric household appliance, such as for example a cooking range, provided with simplified fastening means to a carrying element of the electric household appliance.

BACKGROUND ART

It is known from EP1101067B1 to the same Applicant an electronic gas lighting device including a casing of electrically insulating material fastenable in use to a carrying element of an electric household appliance, e.g. an attachment portion of a cooking range, by means of at least one pair of perforations arranged at an appropriate reciprocal distance on the carrying element and appropriate mated fastening means carried by the casing. These may consist of a pair of teeth, at least one of which elastic, or of fastening screws seats, or of combinations of teeth and screw seats.

The above-described known device is more than satisfactory. However, because the length of the casing depends on the number of burners which the gas lighting device is adapted to drive, as a result, perforations appropriately arranged at a precise reciprocal distance need to be provided for each gas lighting device model; since any one of the cooking ranges may have a different number of burners, according to the model, the electric household appliance manufacturers do not currently obtain the scale economics which could be achieved if, hypothetically, all the gas lighter models could be mounted on the same pair of perforations.

DISCLOSURE OF INVENTION

It is thus the object of the present invention to improve the known gas lighting devices by providing a gas lighting device provided with simplified fastening means to the electric household appliance and such that is it possible to mount different gas lighter models on any cooking range model, all of this ensuring low manufacturing and assembly costs, reduced size and high fastening reliability of the gas lighter to the electric household appliance.

The present invention thus relates to a gas lighting device for an electric household appliance comprising a casing made of electrically insulating material and fastening means of the casing to a carrying element of the electric household appliance, the fastening means being coupleable with corresponding perforations of the carrying element and consisting in at least one pair of elastically deformable fastening elements protrudingly carried overhangingly by the casing, as defined in claim 1.

Specifically, the fastening elements are obtained in a position immediately adjacent one to the other and such that they are adapted to snappingly couple with only one and the same of said perforations of the carrying element of the electric household appliance.

The fastening elements are preferably integrally obtained in one piece with the casing and extend perpendicularly to and protrudingly from one side wall of the casing intended in use to face said perforations. Furthermore, according to a preferred aspect of the invention, the gas lighting device includes a single pair of fastening elements, carried specularly by a single protruding base portion of the casing, so as to be operatively connected to define, on the casing, a single anchoring point of the casing to the electric household appliance.

For this purpose, each fastening element comprises: an arm which protrudingly extends from the casing starting from a bottom end thereof; a first fin which obliquely and protrudingly extends from a free end of said arm, opposite to the bottom end, in a direction such as to approach the casing progressively as it is distanced from the arm in a direction transversal to the same; and a second fin which protrudingly and obliquely extends from the first fin towards the casing but with an inclination contrary to that of the first fin, into proximity with said bottom end of the arm.

In this manner, it is possible to safely fix a gas lighting device of any model, and thus of any length, onto any cooking range model, exploiting a single perforation, instead of a pair of perforations, thus overcoming the limits of the known art, with great advantage of the manufacturers of electric household appliances. Furthermore, the new gas lighting device according to the invention may also be used on existing cooking ranges, by using only one of the perforations already arranged on the same.

BRIEF DESCRIPTION OF THE DRAWINGS

Further features and advantages of the invention will be apparent in the following description of a non-limitative embodiment thereof, with reference to the figures in the accompanying drawing, in which.

BEST MODE FOR CARRYING OUT THE INVENTION

Figure 1:
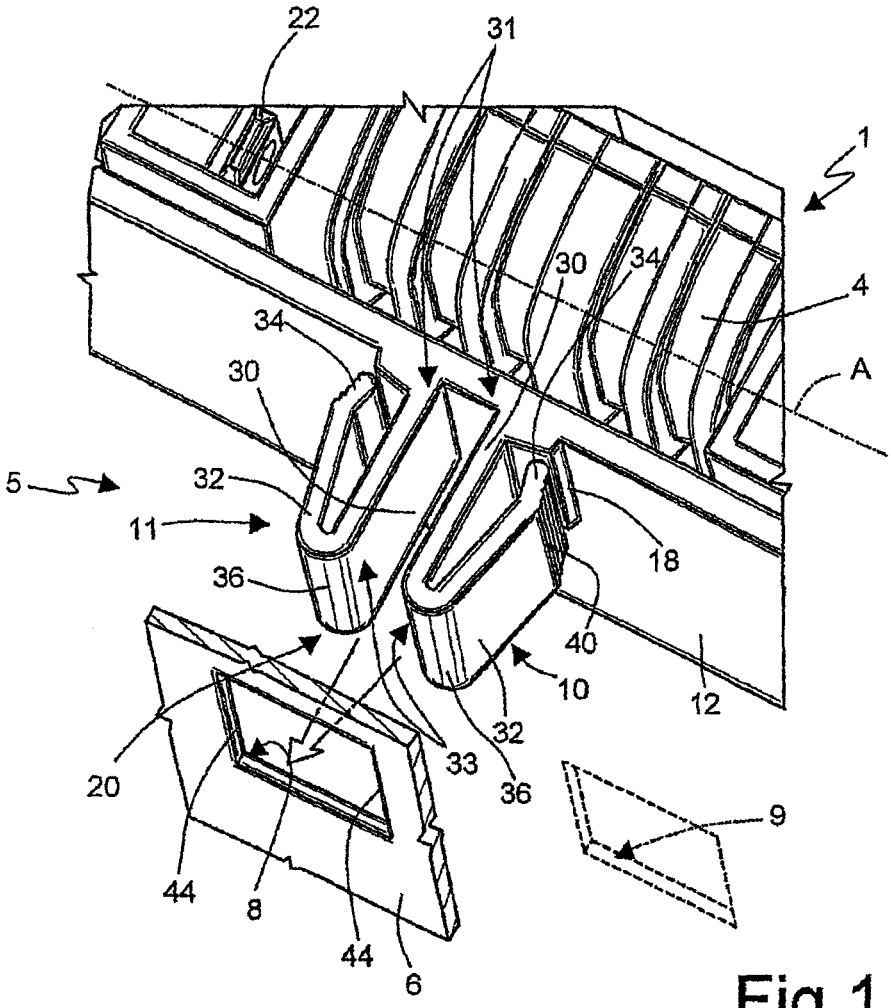
FIG. 1 shows a side three-quarter perspective view of an electronic gas lighting device made according to the invention.
Figure 2:
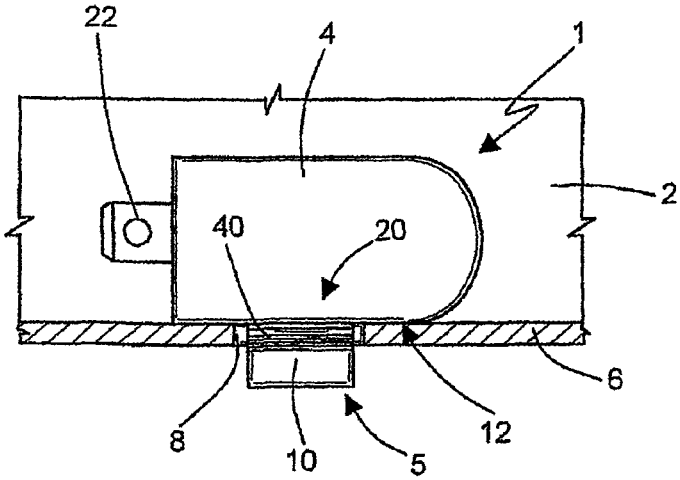
FIG. 2 diagrammatically shows on a reduced scale an elevation side view of the electronic gas lighting device in FIG. 1 mounted on a cooking range.

With reference to FIGS. 1 and 2, numeral 1 indicates as a whole a gas lighting device for an electric household appliance, a cooking range 2 in the non-limiting case in point; the device 1 comprises a casing 4 made of electrically insulating material and fastening means 5 of the casing to a carrying element 6 of the electric household appliance, in the illustrated case in point consisting of an attachment portion for the device 1 of the cooking range 2.

The fastening means 5 are of the type coupleable with corresponding perforations 8, 9 of the carrying element 6 and consist of at least one pair of elastically deformable fastening elements 10, 11 protrudingly carried by the casing 4. In the illustrated example, the perforations 8,9 are of the traditional type, arranged at a reciprocal predetermined distance through the carrying element 6.

Unlike the known gas lighting devices, in which the fastening elements intended to couple with the perforations 8, 9 are obtained reciprocally distanced with the same distance between centres as the perforations 8, 9, the fastening elements 10, 11 of the gas lighting device 1 according to the invention are obtained in a position immediately adjacent to each other and such that they are adapted to simultaneously and snappingly couple with only one and the same of said perforations 8,9 (with the perforation 8, in the illustrated embodiment).

In the example shown, the fastening elements 10, 11 are integrally obtained in one piece with the casing 4, e.g. by moulding the synthetic plastic material of the same, and extend perpendicularly to and protrudingly from a side wall 12 of the casing 4 intended in use to face the perforations 8,9 and the corresponding cooking range 2. Furthermore, the illustrated device 1 presents a single fastening element 10 and a single fastening element 11, so that the fastening means 5 consist of a pair of fastening elements 10, 11, carried specularly by a single protruding base portion 18 of the casing 4, integrally formed on the side wall 12, so as to be reciprocally and operatively connected to define, on the casing 4, a single anchoring point, indicated as a whole by numeral 20, of the casing 4 to the electric household appliance 2.

Furthermore, the fastening elements 10, 11 are reciprocally and symmetrically oriented one with respect to the other according to a longitudinal extension direction of the casing 4, indicated by axis A in FIG. 1, along which the casing 4 presents its maximum extension in length. With respect to such a longitudinal extension direction A, corresponding electric terminals 22 of the device 1 carried by the casing 4 are transversally oriented.

The fastening element 10 is specularly symmetric to the fastening element 11 and each comprises: an arm 30, which protrudingly extends from the casing 4 starting from a bottom end 31 thereof; a first fin 32, which obliquely and protrudingly extends from a free end 33 of the arm 30, opposite to the bottom end 31, in a direction such as to approach the casing 4 progressively as it is distanced from the arm 30 in a direction transversal to the same; and a second fin 34, which protrudingly and obliquely extends from the fin 32 towards the casing 4 although with an inclination contrary to that of the fin 32, into proximity with the bottom end 31 of the arm 30.

The arm 30, the first fin 32 and the second fin 34 of each fastening element 10, 11 are integrally formed in one piece and the fin 32 is connected to the free end 33 by a curve linking portion 36, having a concavity facing towards the casing 4 and adapted to define a preferential bending point of the fastening element 10 or 11, respectively.

The second fin 34 is further delimited on its side opposite to that facing the arm 30 by a toothed face 40 provided with protrusions transversally oriented with respect to the fin 34 itself.

According to the foregoing description, each fastening element 10, 11 displays a size, and is arranged at a distance, in direction A, from the other fastening element, such that the toothed face 40 of the corresponding fin 34 is adapted in use to cooperate with interference with one of the opposite peripheral edges 44 of the perforation 8 delimiting the opposite ends of the same in direction A, while the other toothed face 40 of the other fastening element simultaneously cooperates with the other edge 44.

In this manner, not only is a firm fastening of the casing 4 on the cooking range 2 ensured even though by means of a single attachment point, but in virtue of the conformation of the fins 32, 34, these may in use bend, even differentially, for the two fastening elements 10, 11, so that the protrusions of the toothed faces 40 selectively cooperate one by one with the snapping edges 44.

In this manner, the faces 40 act as ratchets which allow to recover possible size variations of the fastening elements 10, 11 and/or of the cooking range 2 and/or of the perforation 8 due to machining tolerances.

The invention claimed is:

1. A fastening element for removably securing a gas lighting device to a household appliance, said household appliance having a carrying element including an opening bounded by a plurality of peripheral edges, said gas lighting device having a casing including a sidewall, comprising:

a base portion protruding away from a surface of said sidewall;

a first elastically deformable arm attached to and extending outwardly from said base portion; and a second elastically deformable arm attached to and extending outwardly from said base portion, wherein the first arm is spaced apart from the second arm and each arm has one end attached to said base portion, and each arm has an oblique fin extending from a second end opposing said one end of said arm;

wherein the first and second arms, in combination, is configured so that they can snap fit within said opening; and, wherein said base portion defines a single anchoring point and is of a selected width to become secured within said opening so that the upper surface of the carrying element becomes flush against said sidewall when said fastening element is inserted within said opening, and said oblique fins can engage said peripheral edge of said opening to snap secure said gas light device to said household appliance; and wherein each of said fins includes a plurality of teeth on outer end surface thereof engaging said peripheral edges of said opening of said carrying element when said gas lighting device is fully secured within the carrying element, whereby the teeth of said fins act as ratchets against said peripheral edges of said opening of said carrying element so as to allow to recover possible size variations of said fastening element, said household appliance and/or said opening of said carrying element due to matching tolerances, and wherein at least one of:

(i) in an undeformed state, said first and second arms have a uniform thickness from the base to the location where the oblique fins begin;

(ii) in an undeformed state, the shortest distance between the first arm and the second arm is the same from the respective first ends to the second ends where the oblique fin begins; or (iii) wherein the arms have a length, a width and a thickness, the thickness and the width being normal to the length direction, the length direction extending from the first end to the second end of the arm, the thickness being the smallest dimension of the length and the width, the width being the same as a maximum width of the base at any location on the base between the first and second arms.

2. The gas lighting device of claim 1, wherein each of said elastically deformable arms and said oblique fins form a J-shaped element.

3. The fastening element of claim 1, wherein said oblique fins extend form the second end of said arms in a direction to approach the casing progressively and is distanced from the said arm.

4. The fastening element of claim 3, further comprising respective inclined fins extending from said oblique fins towards said casing.

5. The fastening element of claim 4, wherein the plurality of teeth are positioned respectively on said inclined fins.

6. The fastening element of claim 3, wherein said pair of elastically deformable arms are symmetric to each other.

7. The fastening element of claim 1, wherein said arms of said pair of elastically deformable arms are parallel to each other.

8. The fastening element of claim 1, wherein each of said elastically deformable arms and said oblique fins form a J-shaped element.

9. The fastening element of claim 1, wherein, in an undeformed state, said first and second arms have a uniform thickness from the base to the location where the oblique fins begin.

10. The fastening element of claim 1, wherein, in an undeformed state, the shortest distance between the first arm and the second arm is the same from the respective first ends to the second ends where the oblique fin begins.

11. The fastening element of claim 1, wherein a first contiguous portion of the fastener is established by the first arm and the respective oblique fin and a second contiguous portion of the fastener is established by the second arm and the respective oblique fin, wherein the first contiguous portion and the second contiguous portion has at least one of a constant shortest distance between each other or an increasing shortest distance between each other with distance away from the base portion.

12. The fastening element of claim 1, wherein the arms have a length, a width and a thickness, the thickness and the width being normal to the length direction, the length direction extending from the first end to the second end of the arm, the thickness being the smallest dimension of the length and the width, the width being the same as a maximum width of the base at any location on the base between the first and second arms.

13. The fastening element of claim 1, wherein the arms have a length, a width and a thickness, the thickness and the width being normal to the length direction, the length direction extending from the first end to the second end of the arm, the thickness being the smallest dimension of the length and the width, wherein the width is greater than the shortest distance between the first arm and the second arm.

14. The fastening element of claim 1, wherein a first contiguous portion of the fastener is established by the first arm and the respective oblique fin and a second contiguous portion of the fastener is established by the second arm and the respective oblique fin, wherein the first contiguous portion has, on a side facing the second arm, a completely smooth surface from the base to a most distal tip of the contiguous portion away from the base, and wherein the second contiguous portion has, on a side facing the first arm, a completely smooth surface from the base to the most distal tip of the contiguous portion away from the base.

15. A fastening element for removably securing a gas lighting device to a household appliance, said household appliance having a carrying element including an opening bounded by a plurality of peripheral edges, said gas lighting device having a casing including a sidewall, comprising:

a base portion protruding away from a surface of said sidewall;

a first elastically deformable arm attached to and extending outwardly from said base portion; and a second elastically deformable arm attached to and extending outwardly from said base portion, wherein the first arm is spaced apart from the second arm and each arm has one end attached to said base portion, and each arm has an oblique fin extending from a second end opposing said one end of said arm;

wherein the first and second arms, in combination, is configured so that they can snap fit within said opening; and, wherein said base portion defines a single anchoring point and is of a selected width to become secured within said opening so that the upper surface of the carrying element becomes flush against said sidewall when said fastening element is inserted within said opening, and said oblique fins can engage said peripheral edge of said opening to snap secure said gas light device to said household appliance; and wherein each of said fins includes a plurality of teeth on outer end surface thereof engaging said peripheral edges of said opening of said carrying element when said gas lighting device is fully secured within the carrying element, whereby the teeth of said fins act as ratchets against said peripheral edges of said opening of said carrying element so as to allow to recover possible size variations of said fastening element, said household appliance and/or said opening of said carrying element due to matching tolerances, and wherein a first contiguous portion of the fastener is established by the first arm and the respective oblique fin and a second contiguous portion of the fastener is established by the second arm and the respective oblique fin, wherein the first contiguous portion has, on a side facing the second arm, a completely smooth surface from the base to a most distal tip of the contiguous portion away from the base, and wherein the second contiguous portion has, on a side facing the first arm, a completely smooth surface from the base to the most distal tip of the contiguous portion away from the base.

16. A fastening element for removably securing a gas lighting device to a household appliance, said household appliance having a carrying element including an opening bounded by a plurality of peripheral edges, said gas lighting device having a casing including a sidewall, comprising:

a base portion protruding away from a surface of said sidewall;

a first elastically deformable arm attached to and extending outwardly from said base portion; and a second elastically deformable arm attached to and extending outwardly from said base portion, wherein the first arm is spaced apart from the second arm and each arm has one end attached to said base portion, and each arm has an oblique fin extending from a second end opposing said one end of said arm;

wherein the first and second arms, in combination, is configured so that they can snap fit within said opening; and, wherein said base portion defines a single anchoring point and is of a selected width to become secured within said opening so that the upper surface of the carrying element becomes flush against said sidewall when said fastening element is inserted within said opening, and said oblique fins can engage said peripheral edge of said opening to snap secure said gas light device to said household appliance; and wherein each of said fins includes a plurality of teeth on outer end surface thereof engaging said peripheral edges of said opening of said carrying element when said gas lighting device is fully secured within the carrying element, whereby the teeth of said fins act as ratchets against said peripheral edges of said opening of said carrying element so as to allow to recover possible size variations of said fastening element, said household appliance and/or said opening of said carrying element due to matching tolerances, and wherein a first contiguous portion of the fastener is established by the first arm and the respective oblique fin and a second contiguous portion of the fastener is established by the second arm and the respective oblique fin, wherein the first contiguous portion and the second contiguous portion establish an interior of the fastener, which interior is such that the first contiguous portion and the second contiguous portion has at least one of a constant shortest distance between each other or an increasing shortest distance between each other with distance away from the base portion, the distances establishing the interior.

* * * * *